United States Patent [19]

Hori et al.

[11] 3,940,215

[45] Feb. 24, 1976

[54] BLOWER

[75] Inventors: Michimasa Hori, Yao; Takeshi Aizawa, Ikoma, both of Japan

[73] Assignee: Matsushita Electric Industrial Co., Ltd., Osaka, Japan

[22] Filed: Dec. 26, 1973

[21] Appl. No.: 427,733

[30] Foreign Application Priority Data

| | | |
|---|---|---|
| Dec. 28, 1972 | Japan | 48-3330 |
| May 14, 1973 | Japan | 48-53431 |
| Oct. 18, 1973 | Japan | 48-117591 |

[52] U.S. Cl. ..... 415/54; 62/262; 98/94 AC

[51] Int. Cl.[2] ..... B23B 39/00

[58] Field of Search ..... 415/54; 98/94 R, 94 AC; 62/262

[56] References Cited

UNITED STATES PATENTS

| | | | |
|---|---|---|---|
| 2,894,728 | 7/1959 | Davis | 415/54 |
| 3,116,011 | 12/1963 | Laing | 415/54 |
| 3,150,815 | 9/1964 | Laing | 415/54 |
| 3,181,777 | 5/1965 | Coester | 415/54 |
| 3,209,989 | 10/1965 | Eck | 415/54 |
| 3,275,223 | 9/1966 | Fowell | 415/54 |
| 3,275,224 | 9/1966 | Bush | 98/94 |
| 3,276,415 | 10/1966 | Laing | 415/54 |
| 3,800,804 | 4/1974 | Boone | 415/54 |
| 3,833,006 | 9/1974 | Temple | 415/54 |

FOREIGN PATENTS OR APPLICATIONS

| | | | |
|---|---|---|---|
| 355,558 | 8/1961 | Switzerland | 415/54 |

*Primary Examiner*—C. J. Husar

*Attorney, Agent, or Firm*—Stevens, Davis, Miller & Mosher

[57] ABSTRACT

A blower in which on a suction side of a cross flow fan having a vortex stabilizing plate and a back guider is provided a flow dividing guider, which is different from the back guider, for changing the flowing direction of a portion of the air flow. The blower in accordance with the present invention is suitable to be used as a blower for a cooling apparatus, a heating apparatus, a ventilator, and the like, and has a wide variety of applications other than mentioned above.

18 Claims, 13 Drawing Figures

BLOWER

BACKGROUND OF THE INVENTION

Heretofore, there have been used several types of blowers having a cross flow fan in which the flow produced by the fan is changed in the flowing direction thereof. In a blower disclosed in U.S. Pat. No. 3,116,011, a vortex stabilizing plate and a back guider are rotated as an integral unit through 180° about the rotating axis of a fan so that the flowing direction is reversed without changing the rotating direction of the fan itself. And in a blower according to British Pat. No. 876,614, two sets of vortex stabilizing plates and back guiders are provided symmetrically in relation to the axis of a fan. With this arrangement, the back guiders are moved alternately to part from an outer periphery of the fan for adjusting size and shape of spaces on the suction side and delivery side so that the flowing direction is reversed. Further, in a blower of Japanese Pat. Application No, 44,408/1972, a vortex stabilizing plate has connected thereto on the suction side thereof a guider which is different from the vortex stabilizing plate, and the guider is rotated about the connecting portion to reverse the flowing direction.

However, in those blowers, the flow is merely reversed and there always exists only one suction port and only one delivery port. Thus, it is very difficult to divide the air sucked in in one suction port of a fan and deliver the air flows thus produced in two directions which are nearly opposite relative to each other, as is done in the present invention. Viewed from the standpoint of the dividing of an air flow, one method employs diffusers disposed in the delivery port portion to divide the flow, and in another method (U.S. Pat. No. 3,288,355), a back guider is separated into two parts so that the one part can serve as a diffuser for obtaining divided flows. The former method in which the diffusers are arranged in the delivery port is not based on a new idea and only divides the flow in the same direction. The latter method in which the back guider is separated into two parts also merely divides the flow in the nearly same directions. In this case, since the back guider is separated into two parts, the overall flow guiding effect of the two separated back guiders is naturally smaller than the flow guiding effect of the original one back guider, resulting in a decrease in the total amount of air delivered.

SUMMARY OF THE INVENTION

The present invention is based on the idea to provide a flow dividing guider on an air suction side, for dividing the air flow into two flows and delivering the two air flows in the different two directions, in an apparatus in which a vortex stabilizing plate and a back guider are disposed close to the outer periphery of a cross flow fan to form on said cross flow fan the air suction side and an air delivery side.

One object of the present invention is to divide the sucked air in the different two directions and deliver it in such directions, by providing a flow dividing guider on a suction side of a cross flow fan having a vortex stabilizing plate and a back guider.

Another object of the present invention is to make it possible to change the amounts of branching air and circulating air and suck in the air, in the reverse manner, through a branching air delivery port, by rotatably supporting a flow dividing guider arranged on a suction side of a cross flow fan on a shaft parallel to the rotating shaft of the cross flow fan and rotating said flow dividing guider about said shaft.

Still another object of the present invention is to reduce the noise due to a branching air flow by providing a nose in a branching air delivery port.

A further object of the present invention is to provide an apparatus in which there is arranged on a suction side of a cross flow fan a flow dividing guider covering a portion of said cross flow fan in the axial direction thereof, so that, while the room air is circulating in the room, a portion of the room air can be exhausted to the outdoors and the exterior air can be sucked in the apparatus, and which is capable of being used, for instance, as a blower for a cooling or heating apparatus for performing ventilation during a cooling or heating operation.

A still further object of the present invention is to carry out dividing of the sucked air efficiently with a low level of noise.

BRIEF DESCRIPTION OF THE DRAWINGS

These objects and features of the present invention will become more clear by the following description of the preferred embodiment with reference to the attached drawings, in which:

Referring to FIG. 1a, the numeral 1 indicates a cross flow fan provided with a vortex stabilizing plate 2 and a back guider 3. The vortex stabilizing plate 2 and the back guider 3 are indispensable elements for a high-efficiency blower using the cross flow fan 1. The back guider 3 is mounted opposite to the vortex stabilizing plate 2. And viewed in cross section, with the one end thereof located in close vicinity to the cross flow fan 1, the back guider 3 describes a near spiral line in relation to a shaft of said cross flow fan 1, progressively parting from said fan 1. As shown in FIG. 1b, a nearest portion 2*a* of the vortex stabilizing plate 2 and a nearest portion 3*a* of the back guider 3, which are placed at positions nearest to the outer periphery of said cross flow fan 1, are located substantially on a same plane passing through the rotating shaft of said fan 1. The numeral 4 designates a flow dividing guider in accordance with the present invention. The flow dividing guider 4 forms an air suction space together with said vortex stabilizing plate 2 on a suction side of the cross flow fan 1. The flow dividing guider 4 also forms a branching air delivery space together with one end of said back guider 3, which is in the vicinity of the portion of the back guider 3 nearest to the outer periphery of the cross flow fan 1. Having this construction, the flow dividing guider 4 is arranged such that it progressively parts from the outer periphery of the cross flow fan 1 in the same direction as the rotating direction A of said fan 1. Supporting plates 5 support the both ends of the cross flow fan 1, the vortex stabilizing plate 2, the back guider 3, and the flow dividing guider 4. The cross flow fan 1 is rotated in the direction of the arrow A by means of a driving motor 6.

Figure 1A:
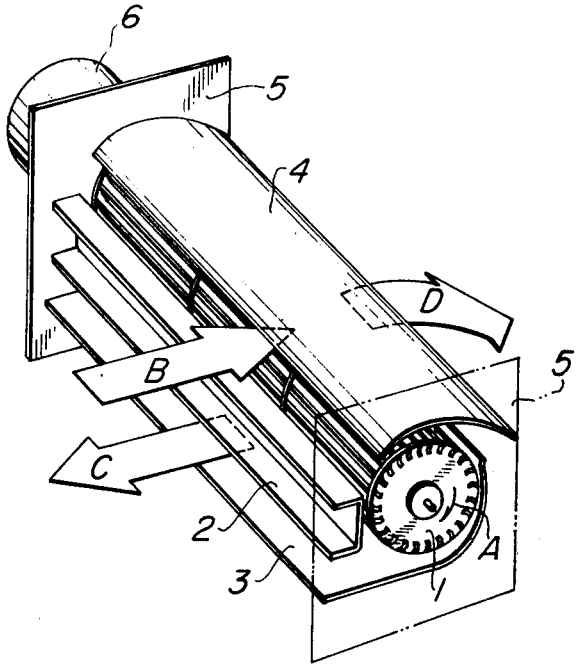
FIG. 1*a* is a view showing the principles of a blower in accordance with the present invention.
Figure 1B:
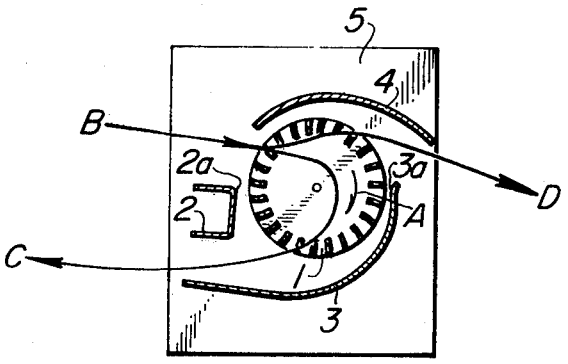
FIG. 1*b* is a longitudinal sectional view of FIG. 1*a;*

In the construction described above, the air sucked in in the direction of the arrow B is divided into two flows in the directions of the arrows C and D. In this case, it should be noted that if the flow dividing guider 4 were not provided, all of the air sucked in in the direction of the arrow B would be delivered in the direction of the arrow C, and the amount of air flow delivered in the direction of the arrow C in such a case would be larger than the amount of air flow delivered in the direction of the arrow C in the case of FIG. 1b. Thus, by providing the flow dividing guider 4, the amount of air flow delivered in the direction of the arrow C is decreased.

If the flow in the direction of the arrow C and the flow in the direction of the arrow D are compared with each other, it is understood that the angular difference between these two flows is upward of 90°. It is not easy to make a comparison between the speeds of these two flows. The flow in the direction of the arrow C is stable and has a speed larger than that of the flow in the direction of the arrow D if the space to suck in the air in the direction of the arrow B is relatively large in area, and a sectional area at right angles to the direction of the flow, of a delivery port through which the flow passes in the direction of the arrow C, is not excessively large in comparison with a sectional area at right angles to the direction of the flow, of a branching air delivery port through which the flow passes in the direction of the arrow D. If these conditions are reversed, the flow in the direction of the arrow D attains a speed higher than that of the flow in the direction of the arrow C, and it becomes possible even to reverse the direction of the flow flowing in the direction of the arrow C for sucking said flow in.

As described above, the ratio of the amount of air flowing in the direction of the arrow C to the amount of air flowing in the direction of the arrow D can be controlled, and the flow delivered in the direction of the arrow C can be reversed to be sucked in in the direction of the arrow D, by suitably changing the sectional areas at right angles to the direction of the flow, of the air suction space, the delivery port formed by the back guider 3, and the branching air delivery space. Since the flow dividing guider 4 is mounted independently of the back guider 3, the length of the flow dividing guider 4 in the rotating direction of the cross flow fan 1 can be determined at any value to obtain a sufficient branching flow, regardless of the position of the one end of the back guider 3 in the vicinity of the portion 3*a* of the back guider 3 nearest to the outer periphery of the cross flow fan 1.

Figure 2:
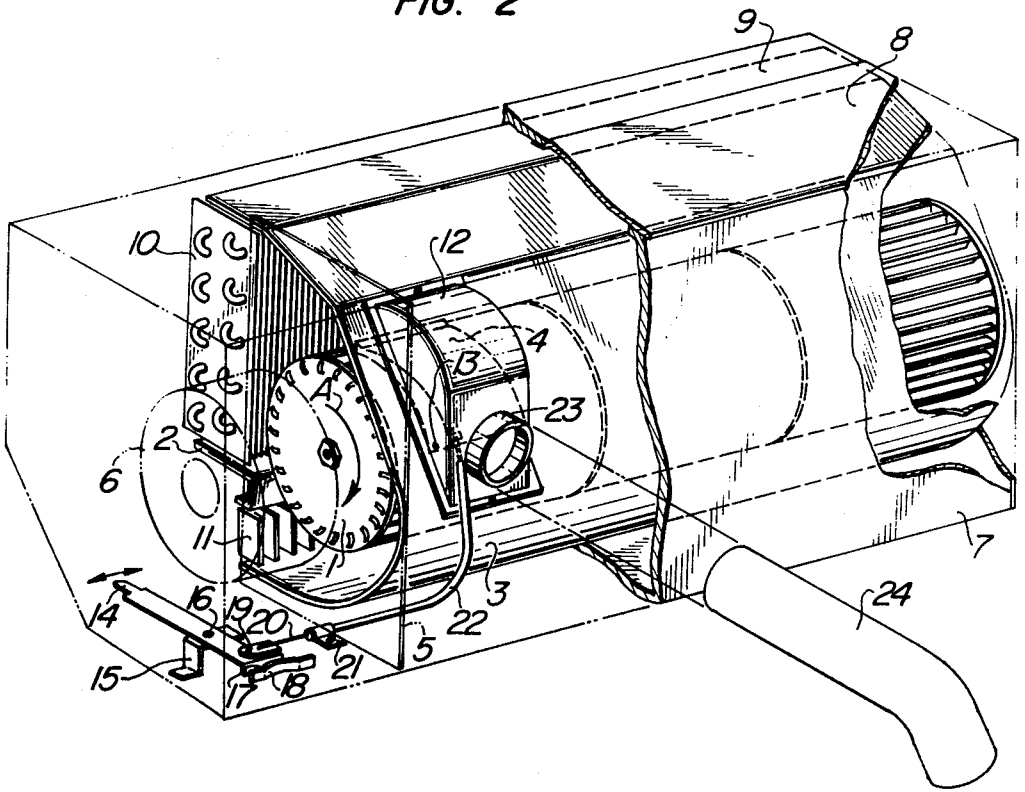
FIG. 2 is a partly broken away back perspective view illustrating a room unit of a separate-type air conditioner in which the blower in accordance with the present invention is employed as a ventilating device.

Turning to FIG. 2, the numeral 7 indicates a base plate of a separate-type air conditioner room unit, on which is mounted an outer case 8 covering the sides and top of the unit. The numeral 9 designates a front grill fixed to the outer case 8. The numeral 10 indicates a heat exchanger for performing heat exchange of the air in the room, which is disposed on the suction side of the cross flow fan 1. The cross flow fan 1 is rotated in the direction of the arrow A by the driving motor 6, so that into the room is delivered the air which passed through the heat exchanger 10 and air direction changing plate 11 due to the actions of the vortex stabilizing plate 2 and the back guider 3. The flow dividing guider 4 in a ventilating device is provided on the suction side of the cross flow fan 1 covering a portion of said fan 1 in the axial direction thereof, and is mounted in a flow dividing guider receiving portion 12 to be rotated about a rotating shaft 13. The flow dividing guider receiving portion 12 is disposed in the rear of the back guider 3. The flow dividing guider 4 is rotated by means of an operating lever 14. By rotating the operating lever 14 about a shaft 16 on an operating lever supporting base 15 using said shaft 16 as a fulcrum, concave portions of a cam 17 fixed to the other end of the operating lever 14 are engaged with a convex portion of a leaf spring 18. With this engagement, an operating wire 20 rotatably attached to the operating lever 14 through a fitting 19 moves in the axial direction in a conduit 22 secured to a fixed fitting 21. As the other end of the operating wire 20 is connected to the flow dividing guider 4, the flow dividing guider 4 is rotated about the rotating shaft 13. The flow dividing guider 4 has a stopper (not shown) to prevent the flow dividing guider 4 from contacting the outer periphery of the cross flow fan 1. The flow dividing guider receiving portion 12 is formed with a ventilating hole 23 to which is detachably fixed a ventilating duct 24.

Figure 3:
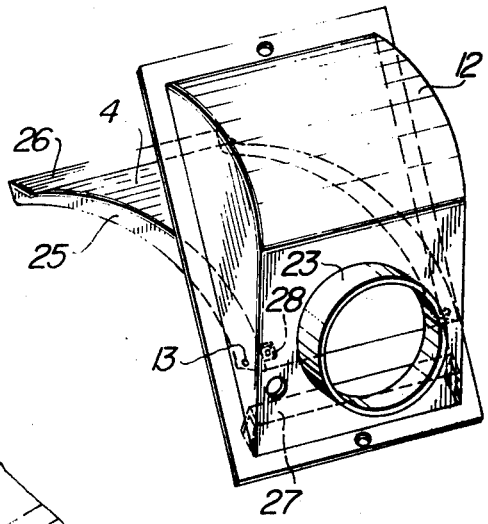
FIG. 3 is a view showing a body of said ventilating device.

FIG. 3 shows a body of the ventilating device in a more detailed manner than FIG. 2. Turned down portions 25 are arranged on two ends of the flow dividing guider 4 in the axial direction of the cross flow fan 1. The turned down portions 25 extend in a direction at right angles to the shaft of the cross flow fan 1, and the amount of air exhausted can be best increased by providing the turned down portions 25 in such a manner that their outer edges extend along the outer periphery of the cross flow fan 1 as close to said outer periphery of said fan 1 as possible. At the end of the flow dividing guider 4 opposite to the portion where the rotating shaft 13 is disposed, there is provided a whistle sound preventing bend 26 in a manner to part from the outer periphery of the cross flow fan 1. Near the ventilating hole 23 is arranged an exhaust air guiding nose 27 having a length nearly equivalent to the width of the flow dividing guider 4, and an attaching arm 28 for the operating wire 20 is disposed in the vicinity of the rotating shaft 13 of the flow dividing guider 4.

Figure 4:
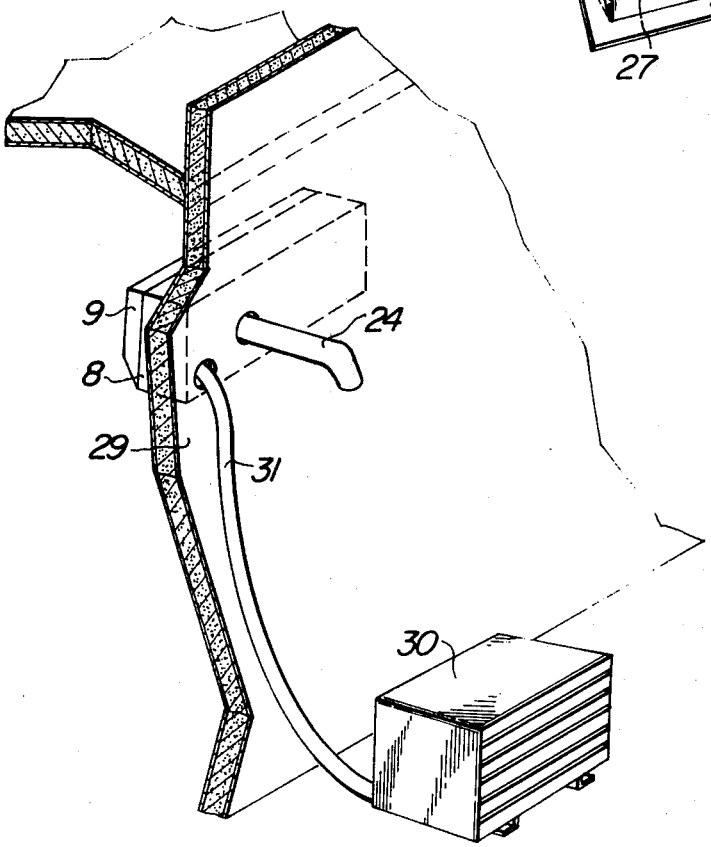
FIG. 4 is a view illustrating the installation of a separate-type air conditioner having the ventilating device.

Referring to FIG. 4, the room unit is mounted on a wall 29 and connected to an outdoor unit 30 by means of a refrigerant tube 31. In the wall 29 are drilled two holes for the refrigerant tube 31 and the ventilating duct 24.

Figure 5:
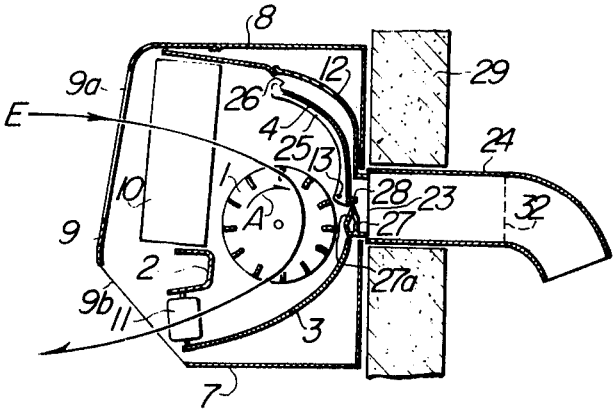
FIGS. 5 through 7 are sectional views showing a mounting portion of the ventilating device of the air conditioner room unit, with FIG. 5 illustrating a state in which a ventilating passage is closed to allow the air to circulate in the room, FIG. 6 showing a state in which the exterior air is being sucked in, and FIG. 7 illustrating a state in which a portion of the air in the room is being exhausted to the outdoors.
Figure 6:
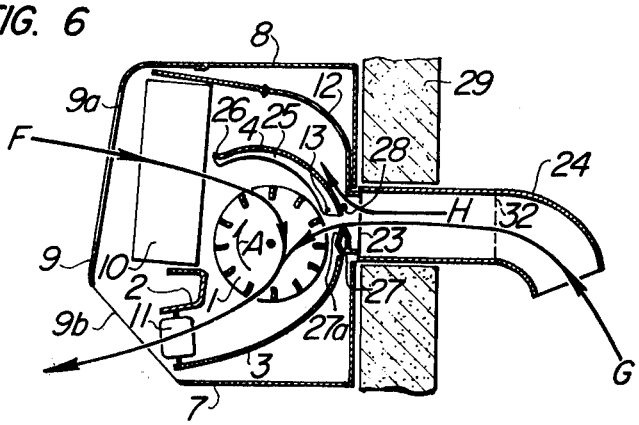
Figure 7:
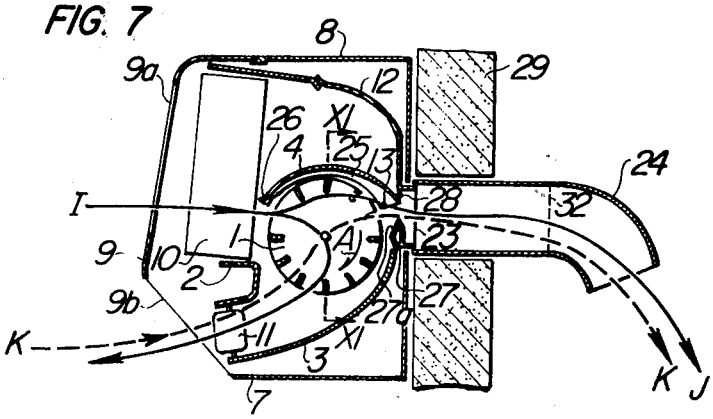

Turning to FIGS. 5 through 7, an insect net 32 is provided in the ventilating duct 24, and the front grill 9 has suction ports 9*a* and delivery ports 9*b*. In the three figures, the operating wire 20 is not shown.

Figure 12:
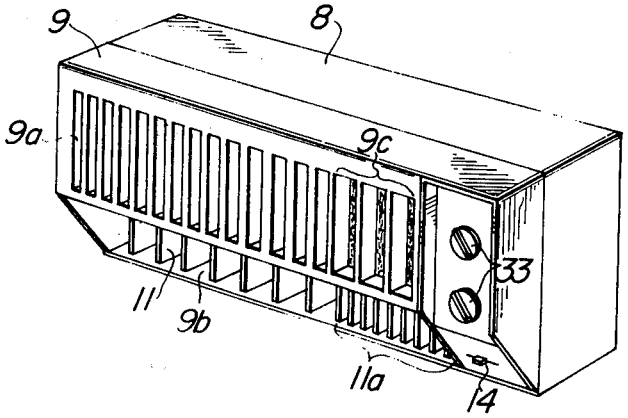
FIG. 12 is a front perspective view of the room unit.

Referring to FIG. 12, the numeral 33 indicates operating knobs of the room unit while the numeral 9*c* designates a portion where the suction ports 9*a* have larger opening areas. The numeral 11a indicates a portion where the air direction changing plates 11 are increased in number. The flow dividing guider 4 is accommodated behind the portions 9*c* and 11*a*.

In the construction described above, when the cross flow fan 1 is rotated in the direction of the arrow A, with the flow dividing guider 4 received in the flow dividing guider receiving portion 12 as shown in FIG. 5, the air is sucked in in the suction port 9*a* as indicated by the arrow E and undergoes heat exchange in the heat exchanger 10 to flow through the cross flow fan 1 and down to the air direction changing plates 11. Then, the air is delivered through the delivery port 9*b* to return to the room. The movement of the air is the same as in the conventional blower having no flow dividing guider. In this case, the ventilating hole 23 is closed by the flow dividing guider 4, blocking the inflow of the external air.

If the flow dividing guider 4 is rotated about the rotating shaft 13 for opening the ventilating hole 23 to establish a communication with the exterior air, the exterior air is sucked in in the direction of the arrow G to be delivered into the room together with the air flow in the direction of the arrow F, as is shown in FIG. 6. However, in a portion of the cross flow fan 1 where there is no flow dividing guider 4 covering said fan 1 in the axial direction thereof, the air flows in the direction of the arrow E in FIG. 5. This applies also to the operation shown in FIG. 7. When sucking in the exterior air as described above, the problem arising is to what position the flow dividing guider 4 should be rotated. In case the flow dividing guider 4 is rotated only a small distance from the position shown in FIG. 5, the ventilating hole 23 also opens only slightly, resulting in a very limited amount of the air sucked in. And in case the flow dividing guider 4 is rotated to a position in which the flow dividing guider 4 extends in the peripheral direction of the cross flow fan 1 along the outer periphery of said fan 1, with substantially equal distances maintained between said guider 4 and the outer periphery of said fan 1 along said outer periphery, the flow dividing guider 4 begins to act as an air guiding plate for the branching flow, and it very often happens that the air in the room is discharged to the outdoors through the ventilating hole 23. Thus, in this case too, no large amount of the exterior air can be expected to be sucked in.

Therefore, in order to obtain a maximum amount of air sucked in, the flow dividing guider 4 should be placed in a position in which the flow dividing guider 4 extends in a direction opposite to the rotating direction (the arrow A) of the cross flow fan 1 along the outer periphery of said fan 1, progressively parting from said outer periphery, and at the same time, the ventilating hole 23 is opened to a degree permitting a sufficient communication with the exterior air. Sometimes the exterior air is sucked in flowing on the back side of the flow dividing guider 4, as shown in the figure by the arrow H.

Turning to FIG. 7, if the flow dividing guider 4 is rotated about the rotating shaft 13 to be placed close to the outer periphery of the cross flow fan 1, the flow dividing guider 4 acts as an air guiding plate, so that a portion of the air sucked in as indicated by the arrow I is exhausted to the outdoors through the ventilating hole 23 and the ventilating duct 24 as shown by the arrow J, and the rest of the air sucked in is delivered into the room. In this case, a large decrease does not occur in the amount of air delivered into the room since the flow dividing guider 4 is arranged to cover only a portion of the cross flow fan 1 in the axial direction of said fan 1. Thus, the room can be ventilated during the cooling or heating operatiton which is performed by passing a heat medium in the heat exchanger 10. What is more, the diameter of the ventilating hole 23 need not be large enough to cover the entire axial length of the cross flow fan 1, so that a ventilating duct 24 having a small diameter can be used, making the diameter of a hole drilled in the wall 29 small.

In designing the blower in accordance with the present invention as described in the foregoing, the problems relating to the amount of air exhausted are to what position the flow dividing guider 4 should be rotated in bringing said guider 4 in close vicinity to the outer periphery of the cross flow fan 1, the width of the flow dividing guider 4 in the axial direction of the cross flow fan 1, the position of the flow dividing guider 4 in the axial direction of the cross flow fan 1, the relative positions of the nose 27 and the flow dividing guider 4, the vertical position, inner diameter, and size of the ventilating hole 23, the air passage resistances on the suction side and the delivery side which are formed by the vortex stabilizing plate 2 and the back guider 3 in a portion of the blower where the flow dividing guider 4 is provided, the space between the whistle sound preventing bend 26 and the vortex stabilizing plate 2, and the like. Hereinafter explanations will be given on the important ones of the problems described above.

Figure 8:
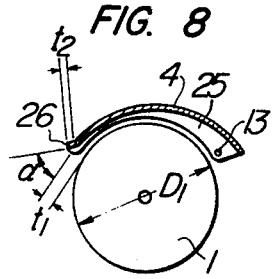
FIG. 8 is a sectional view showing a cross flow fan and a flow dividing guider of FIG. 7 and taken in a direction at right angles to a shaft of said cross flow fan.
Figure 9:
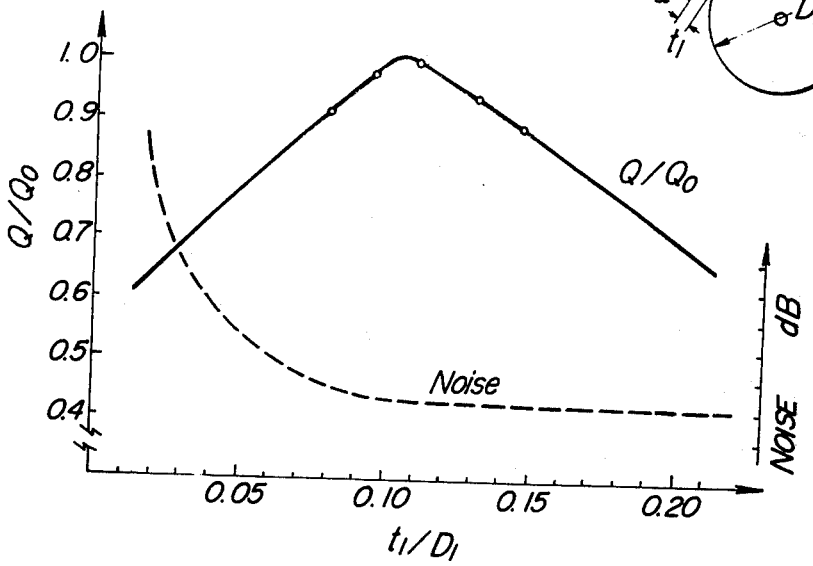
FIG. 9 is a diagram showing the changes in amounts of air exhausted and noise corresponding to the change in position of the flow dividing guider.

In the first place, the relative positions of the flow dividing guider 4 and the cross flow fan 1 are considered. Referring to FIG. 8, noise including a whistle sound will be increased in amount if the distance $t_1$ at a point where a portion of the flow dividing guider 4 close to the whistle sound preventing bend 26 comes nearest to the outer periphery of the cross flow fan 1, is determined at a value which is excessively small. On the other hand, a great amount of air exhausted cannot be obtained if the distance $t_1$ is determined at a value which is excessively large. This interrelationship is shown in FIG. 9. In the figure, along the abscissa are plotted the ratios of the distances $t_1$ to the outer diameter of the cross flow fan 1 $D_1$, while along the ordinate are plotted the ratios of the amounts of air exhausted at various times Q to the amount of air exhausted at the time $t_1/D_1 = 0.11$ Qo. In addition, there is shown a tendency of the change in noise value corresponding to the change in $t_1/D_1$ value. As can be clearly seen in the figure, there is an optimum range for the ratio $t_1/D_1$. An examination was done on the change in relationship between the ratios $t_1/D_1$ and Q/Qo by moving the flow dividing guider 4 in the axial direction of the cross flow fan 1. As a result, it was found that, in some cases, the value of the ratio Q/Qo did not decrease sharply when the value of the ratio $t_1/D_1$ was decreased from 0.11, in contrast to the case shown in FIG. 9. However, even in these cases, the noise had a tendency to change nearly identical with that indicated in FIG. 9. In conclusion, it can be said that about 0.03 – 0.20 is the optimum range for the value of the ratio $t_1/D_1$.

Figure 10:
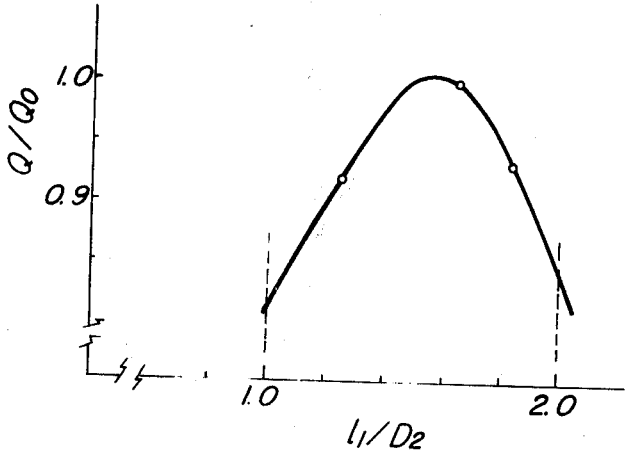
FIG. 10 is a diagram showing the change in amount of air corresponding to the change in ratio of the flow dividing guider width to ventilating hole diameter.

Examined next was the width of the flow dividing guider 4 in the axial direction of the cross flow fan 1. This width has something to do with the size of the ventilating hole 23. That is to say, in order to obtain a better result, this width should be increased according to an increase in the dimension of the ventilating hole 23 in the axial direction of the cross flow fan 1. A very good effect can be attained by providing a flow dividing guider 4 having a width slightly larger than the size of the ventilating hole 23. FIG. 10 shows this relationship. In the figure, along the abscissa are plotted the ratios of the widths of the flow dividing guider 4 in the axial direction of the cross flow fan 1 $l_1$ to the inner diameter of the ventilating hole 23 $D_2$, while along the ordinate are plotted the ratios of the amounts of air exhausted at various times Q to the amount of air exhausted at the time $l_1/D_2 = 1.64$ Qo. As can be understood from the figure, about 1.0 – 2.0 is the optimum range for the value of the ratio $l_1/D_1$.

Figure 11:
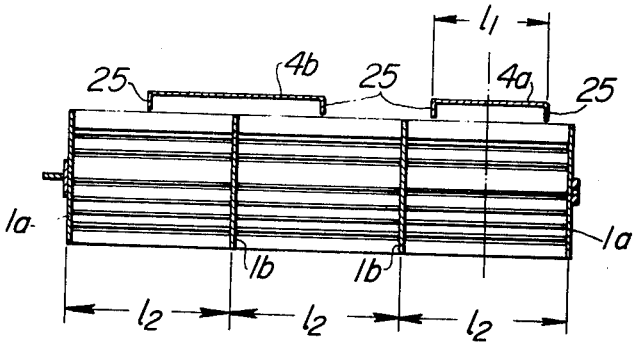
FIG. 11 is a sectional view taken along the line XI—XI in FIG. 7 and illustrates only the cross flow fan and the flow dividing guiders for explaining the positioning of the flow dividing guider in the axial direction of said cross flow fan.

Then, let us consider the position of the flow dividing guider 4 in the axial direction of the cross flow fan 1. The determination of this position is influenced by such factors as the width of the flow dividing guider 4 $l_1$, the relative positions of the flow dividing guider 4 and side plates 1*a* of the cross flow fan 1, the relative positions of the flow dividing guider 4 and partition plates 1*b*, and the like, as shown in FIG. 11. When the width $l_1$ is smaller than the width $l_2$ in the axial direction of the cross flow fan 1, of a portion of said fan 1 formed by substantially equally dividing said fan 1 in the axial direction thereof by the partition plates 1*b*, a favorable result can be obtained by arranging the width $l_1$ in the central part of the width $l_2$ as exemplified by the flow dividing guider 4*a* in FIG. 11, or by arranging the width $l_1$ such that one partition plate 1*b* is positioned in the center of the width $l_1$ as exemplified by the flow dividing guider 4 *b* in FIG. 11. In the event the width $l_1$ is larger than the width $l_2$, it is better to arrange the width $l_1$ so that one partition plate 1b is placed in the center of the width $l_1$ as shown by the flow dividing guider 4b in FIG. 11.

Next, an examination will be made on the air passage resistances on the suction side and the delivery side which are formed by the vortex stabilizing plate 2 and the back guider 3 in a portion of the blower where the flow dividing guider 4 is provided. A good result can be attained by making the ratio of the air passage resistance on the suction side to the air passage resistance on the delivery side smaller than such a ratio in a portion of the blower where the flow dividing guider 4 is not provided. FIG. 12 illustrates an embodiment realizing the above principle. In this embodiment, the flow dividing guider 4 is disposed on a side near the operating knobs 33 of the room unit, and the suction ports 9*a* in a portion where the flow dividing guider 4 is disposed have, as shown at 9*c*, larger opening areas than the suction ports 9*a* in the other portion. Additionally, in said portion where the flow dividing guider 4 is disposed, the air direction changing plates 11 in the delivery ports 9*b* are increased in number in comparison with said plates 11 in the other portion, as shown at 11a in the figure. Thus, in said portion where the flow dividing guider 4 is disposed, a larger amount of the room air is sucked in through the ports 9*c* compared with the other portion, and thanks to a great delivery resistance at 11*a*, the amount of air exhausted by the flow dividing guider 4 is increased.

Turning to FIG. 7, if a space between the whistle sound preventing bend 26 and the vortex stabilizing plate 2 is too small, all of the flow in the direction of the arrow I flows in the direction of the arrow J, and as shown by the arrow K, sucks in the room air through the delivery ports in a manner reverse to normal, and then passes through the air direction changing plates 11, the cross flow fan 1, and the ventilating duct 24 for being exhausted to the outdoors. If said space is too large, the length of the flow dividing guider 4 in the peripheral direction of the cross flow fan 1 is not sufficient to expect a large amount of air exhausted. Thus, said space must have an appropriate length in order to obtain the flows indicated by the arrows I and J in FIG. 7.

Referring again to FIG. 7, principal sources of noise in this ventilating device are a portion where one end of the flow dividing guider 4 and the outer periphery of the cross flow fan 1 are brought nearest to each other, and the nose 27. As for the noise produced in said portion where one end of the flow dividing guider 4 and the outer periphery of the cross flow fan 1 are brought nearest to each other, it is recommended to arrange the whistle sound preventing bend 26 in a portion of the flow dividing guider 4 nearest to the outer periphery of the cross flow fan 1, so that the flow passing through the first mentioned portion is not distrubed. In this case, the bend length $l_2$ shown in FIG. 8 must have a suitable value, and the value of the bending angle $\alpha$ must be chosen within a range of 10° –90° depending upon the particular state of use. The shape of the surface of the whistle sound preventing bend 26 need not be a plane through all instances, a curved surface being acceptable. As for the noise produced around the nose 27, a dominant factor in the solution of this particular noise problem is the relation between an inclined surface 27*a* and the outer periphery of the cross flow fan 1, as can be seen in FIG. 7. In this case too, as is the case with said whistle sound preventing bend 26, there are optimum ranges for the length, shape, and angle of the inclined surface 27*a* to obtain a minimum amount of whistle sound and a maximum amount of air exhausted.

We claim:

1. A blower for blowing air, comprising: a cross flow fan; a vortex stabilizing plate spaced apart from one side of the outer periphery of the fan; a back guider spaced apart from the outer periphery of the fan and extending from the side of said fan opposite said one side towards said stabilizing plate, said fan, said stabilizing plate and said back guider forming, on the same side of said fan, an air suction side and an air delivery side; and on said air suction side a flow dividing guider, which with said back guide forms a branching air delivery space on the opposite side of said air suction side, for dividing the air flow and enabling the air to flow in substantially two opposite directions from said air suction side back to said air delivery side and to said branching air delivery space, respectively.

2. A blower for blowing air, comprising: a cross flow fan; a vortex stabilizing plate spaced apart from one side of the outer periphery of the fan; a back guider, located in a position opposite to the position of said vortex stabilizing plate, with said cross flow fan located therebetween, said back guider being in the form of a curved surface which parts progressively from the outer periphery of said cross flow fan in the rotating direction of said cross flow fan; and a flow dividing guider, disposed on a suction side of said cross flow fan and parting progressively from the outer periphery of the cross flow fan in the rotating direction of said cross flow fan, an air suction space being formed between said flow dividing guider and said vortex stabilizing plate, a branching air delivery space being formed between said flow dividing guider and said back guider, and an air delivery space being formed between said vortex stabilizing plate and said back guider, said flow dividing guider including means for enabling air to flow in two substantially opposite directions from said air suction space back to said air delivery space and to said branching air delivery space.

3. A blower in accordance with claim 2 in which said back guider is mounted to be rotatable about an axis parallel to the rotating shaft of the cross flow fan.

4. A blower in accordance with claim 2 in which there is further provided a nose for guiding the branching air which is located on the back guider side in the branching air delivery space.

5. A blower for blowing air, comprising: a cross flow fan; a vortex stabilizing plate spaced apart from one side of the outer periphery of the fan; a back guider, located in a position opposite to the position of said vortex stabilizing plate, with said cross flow fan located therebetween, said back guider being in the form of a curved surface which parts progressively from said cross flow fan in the rotating direction of said cross flow fan; and a flow dividing guider, disposed on a suction side of said cross flow fan and rotatable about an axis parallel to the rotating shaft of said cross flow fan, for dividing the air flow and enabling the air to flow in two substantially opposite directions, one of the directions being back towards the air suction side.

6. A blower in accordance with claim 5 in which a space between said flow dividing guider and said vortex stabilizing plate is used as an air suction port, and a space between said flow dividing guider and said back guider is used as a branching air delivery port.

7. A blower in accordance with claim 5 in which a space between said flow dividing guider and said back guider is used as an air suction port for sucking in air in addition to said air suction side.

8. A blower in accordance with claim 5 in which said flow dividing guider closes a space formed between said flow dividing guider and said back guider.

9. A blower in accordance with claim 5 in which there is provided on a back guider side in a space between said flow dividing guider and said back guider a nose with which said flow dividing guider comes in engagement when said flow dividing guider closes said space between said flow dividing guider and said back guider.

10. A blower for blowing air, comprising: a cross flow fan: a vortex stabilizing plate spaced apart from one side of the outer periphery of the fan; a back guider, located in a position opposite to the position of said vortex stabilizing plate, with said cross flow fan located therebetween, said back guider being in the form of a curved surface which parts progressively from the outer periphery of said cross flow fan in the rotating direction of said cross flow fan; and a flow dividing guider, disposed on a suction side of said cross flow fan and having a width equivalent to a portion of the axial length of said cross flow fan, wherein spaces are formed between said flow dividing guider and said vortex stabilizing plate and between said flow dividing guider and said back guider, said flow dividing guider including means for enabling air to flow in two substantially opposite directions, one of the directions being back towards the suction side.

11. A blower in accordance with claim 10 in which the space between the flow dividing guider and the vortex stabilizing plate is used as an air suction port, and the space between said flow dividing guider and the back guider is used as a branching air delivery port.

12. A blower in accordance with claim 11 in which a nose for guiding branching air in the branching air delivery port is further provided on the side of said back guider in the branching air delivery port.

13. A blower in accordance with claim 10 in which the space between the flow dividing guider and the back guider is used as an air suction port for sucking in air in addition to said air suction side.

14. A blower in accordance with claim 10 in which there is disposed near said space between said flow dividing guider and said back guider a branching air delivery port and the width of the flow dividing guider is about 1 – 2 times the width of said branching air delivery port in the axial length of the cross flow fan.

15. A blower in accordance with claim 10 in which end edges of said flow dividing guider located in the axial direction of the cross flow fan are turned down toward the cross flow fan making substantially a right angle with the surface of said flow dividing guider.

16. A blower in accordance with claim 10 in which the ratio of the air passage resistance on the suction side in a portion of the blower where said flow dividing guider is provided in the axial direction of the cross flow fan to the air passage resistance on a delivery side in said portion of the blower, is smaller than the ratio of the air passage resistance on the suction side in a portion of the blower where said flow dividing guider is not provided to the air passage resistance on the delivery side in said portion of the blower where said flow dividing guider is not provided.

17. A blower for blowing air, comprising: a cross flow fan; a vortex stabilizing plate spaced apart from one side of the outer periphery of the fan; a back guider, located in a position opposite to the position of said vortex stabilizing plate, with said cross flow fan located therebetween, said back guider being in the form of a curved surface which parts progressively from the outer periphery of said cross flow fan in the rotating direction of said cross flow fan; and a flow dividing guider, disposed on a suction side of said cross flow fan and having a width equivalent to a portion of the axial length of said cross flow fan, said flow dividing guider being rotatably supported on a shaft parallel to the rotating shaft of said cross flow fan, and wherein spaces are formed between said flow dividing guider and said vortex stabilizing plate and between said flow dividing guider and said back guider, said flow dividing guider including means for enabling air to flow in two substantially opposite directions, one of the directions being back towards the air suction side.

18. A blower in accordance with claim 17 in which the positional relation between said flow dividing guider support shaft and said flow dividing guider is so determined that, when said flow dividing guider is rotated about said flow dividing guider support shaft in the same direction as the rotating direction of said cross flow fan, said flow dividing guider closes a space formed between said flow dividing guider and said back guider.

* * * * *